United States Patent [19]

Diener

[11] Patent Number: 4,726,342

[45] Date of Patent: Feb. 23, 1988

[54] FUEL-AIR RATIO (LAMBDA) CORRECTING APPARATUS FOR A ROTOR-TYPE CARBURETOR FOR INTEGRAL COMBUSTION ENGINES

[75] Inventor: Rudolf Diener, Zurich, Switzerland

[73] Assignee: Kwik Products International Corp., Portland, Oreg.

[21] Appl. No.: 877,445

[22] Filed: Jun. 30, 1986

[51] Int. Cl.[4] ..... F02M 17/00

[52] U.S. Cl. ..... 123/438; 123/492; 261/88; 261/34.2

[58] Field of Search ..... 123/438, 492; 261/34 A, 261/44, 88, 69 R

[56] References Cited

U.S. PATENT DOCUMENTS

| | | | |
|---|---|---|---|
| Re. 89,060 | 12/1876 | Reddy | 123/32 |
| 791,801 | 6/1905 | Leinau . | |
| 957,976 | 5/1910 | Lucas . | |
| 1,061,995 | 5/1913 | Erickson . | |
| 1,092,079 | 3/1914 | Reeder . | |
| 1,106,258 | 8/1914 | Tucker et al. . | |
| 1,120,763 | 12/1914 | Thomas | 261/88 |
| 1,153,077 | 9/1915 | Hippel . | |
| 1,174,529 | 3/1916 | Sykes | 261/88 |
| 1,283,294 | 10/1918 | Porter . | |
| 1,303,761 | 5/1919 | Bouteille | 261/88 |
| 1,360,445 | 11/1920 | Rollins | 261/88 |
| 1,439,573 | 12/1922 | Orem . | |
| 1,529,612 | 3/1925 | Assmus . | |
| 1,597,072 | 8/1926 | Henkle . | |
| 1,636,187 | 7/1927 | Kessel | 261/88 |
| 1,730,410 | 10/1929 | Dennison | 261/88 |
| 1,746,439 | 2/1930 | Murrer | 261/88 |
| 1,767,305 | 6/1930 | Musall | 261/88 |
| 2,119,922 | 6/1938 | Lutz | 261/84 |
| 2,188,189 | 1/1940 | Miller, Jr. | 261/89 |
| 2,197,647 | 4/1940 | Lorenzen | 110/104 |
| 2,211,552 | 8/1940 | Bernstein et al. | 261/89 |
| 2,223,836 | 12/1940 | Snyder | 261/88 |
| 2,665,892 | 1/1954 | Rumpler | 261/89 |
| 2,668,698 | 2/1954 | Rollins | 261/41 |

(List continued on next page.)

FOREIGN PATENT DOCUMENTS

| | | | |
|---|---|---|---|
| 749179 | 7/1933 | France | 261/88 |
| 606784 | 11/1978 | Switzerland | 261/88 |
| 191633 | 1/1923 | United Kingdom | 261/88 |
| 827861 | 2/1960 | United Kingdom | 261/88 |

*Primary Examiner*—Ronald B. Cox

*Attorney, Agent, or Firm*—Hubbard, Thurman, Turner & Tucker

[57] ABSTRACT

An airstream driven rotor assembly with a centrifugal pump forcing a measured fuel quantity through a fixed orifice in direct substantially linear proportion to rotor speed and thus to airstream volume. The ultimate fuel-air ratio is corrected for optimum operation by slightly changing, in response to measured parameters, one of the mixture constituents. In one embodiment, the fuel discharge bore (9) of a rotor (7) is dimensioned that the rotor carburetor (2) produces a lean mixture with a λ-value which is constant for all operating points approximately 1.25. For fuel-air ratio correction additional fuel is brought into atomization ring (11) of rotor (7), by which the fuel-air ratio in the lean mixture is changed and at the engine operating points the λ-values are adjusted to give most favorable fuel consumption, output and pollution. The fuel-air ratio correction apparatus includes a regulated injection pump (20) with an injection nozzle (39*a*) directed at the internal wall (13) of the atomization ring (11) with approximately 50 $mm^3$ of additional fuel delivered per stroke, and a regulating device (50) with a pulse generator (40) for driving injection pump (20) with pulses of regulated frequency. The regulation of repetition frequency is controlled by control signal generators in dependence on operating parameters of the engine such as opening of the throttle valve (18) for acceleration correction, coolant temperature for the cold start correction, etc. In other embodiments, the air volume is reduced to enrich the mixture, and in another, the air velocity is increased to enrich the mixture.

15 Claims, 7 Drawing Figures

U.S. PATENT DOCUMENTS

| | | | |
|---|---|---|---|
| 2,759,718 | 8/1956 | Gideon | 261/65 |
| 2,791,409 | 5/1957 | Lauder | 261/71 |
| 2,823,906 | 2/1958 | Gideon | 261/56 |
| 2,998,230 | 8/1961 | Perretti | 261/30 |
| 3,208,738 | 9/1965 | Johnson | 261/23 |
| 3,279,769 | 10/1966 | Zysk | 261/35 |
| 3,439,903 | 4/1969 | Tolnai | 261/44 |
| 3,548,792 | 12/1970 | Palmer | 123/438 |
| 3,661,126 | 5/1972 | Batendale | 123/438 |
| 3,704,702 | 12/1972 | Aono | 123/179 |
| 3,829,071 | 8/1974 | Valbona et al. | 261/89 |
| 3,920,778 | 11/1975 | De Rugeris | 261/39 |
| 3,960,118 | 6/1976 | Konomi et al. | 123/32 |
| 3,991,144 | 11/1976 | Diener | 261/36 |
| 4,036,186 | 7/1977 | Hattori | 123/438 |
| 4,044,081 | 8/1977 | Weidlich | 261/51 |
| 4,055,609 | 10/1977 | Phelps | 261/36 A |
| 4,057,604 | 11/1977 | Rollins | 261/88 |
| 4,106,453 | 8/1978 | Burley | 123/120 |
| 4,168,679 | 9/1979 | Ikeura et al. | 123/32 |
| 4,170,975 | 10/1979 | Wessel et al. | 123/139 |
| 4,187,264 | 2/1980 | Diener | 261/84 |
| 4,196,264 | 4/1980 | Troedsson et al. | 429/114 |
| 4,207,274 | 6/1980 | Phillips | 261/50 |
| 4,245,317 | 1/1981 | Marchak | 364/431 |
| 4,249,496 | 2/1981 | Shimazaki | 123/438 |
| 4,274,141 | 6/1981 | Tukuda et al. | 364/431 |
| 4,283,358 | 8/1981 | Deiner | 261/88 |
| 4,353,848 | 10/1982 | Carsten | 261/69 |
| 4,366,541 | 12/1982 | Mouri et al. | 364/431.05 |
| 4,368,705 | 1/1983 | Stevenson et al. | 123/357 |
| 4,369,149 | 1/1983 | Violett | 261/44 |
| 4,377,137 | 3/1983 | Amano et al. | 123/179 |
| 4,399,792 | 8/1983 | Otsuka et al. | 123/489 |
| 4,401,080 | 8/1983 | Otsuka et al. | 123/440 |
| 4,407,248 | 10/1983 | Takeuchi | 123/438 |
| 4,411,234 | 10/1983 | Middleton | 123/485 |
| 4,413,601 | 11/1983 | Matsuoka et al. | 123/480 |
| 4,455,981 | 6/1984 | Suzuki | 123/438 |
| 4,457,282 | 7/1984 | Muramatsu et al. | 123/486 |
| 4,463,731 | 8/1984 | Matsuoka | 123/492 |
| 4,474,712 | 10/1984 | Diener | 261/88 |
| 4,485,795 | 12/1984 | Lockard | 123/590 |
| 4,492,202 | 1/1985 | Muramatsu et al. | 123/478 |
| 4,495,921 | 1/1985 | Sawamoto | 123/438 |
| 4,495,927 | 1/1985 | Yamato | 123/491 |
| 4,496,286 | 1/1985 | Gagnon | 417/22 |
| 4,503,003 | 3/1985 | Gilbert | 261/51 |
| 4,512,319 | 4/1985 | Williams et al. | 123/492 |
| 4,522,766 | 6/1985 | Sunada | 261/91 |
| 4,543,937 | 10/1985 | Amano et al. | 123/491 |
| 4,546,748 | 10/1985 | Karino et al. | 123/494 |

FUEL-AIR RATIO (LAMBDA) CORRECTING APPARATUS FOR A ROTOR-TYPE CARBURETOR FOR INTEGRAL COMBUSTION ENGINES

The invention concerns a fuel-air ratio (λ) correcting apparatus in a rotor-type carburetor for internal combustion engines with spark ignition for producing a fuel-air mixture with variable ratio matched to the requirements of the internal combustion engine at different operating points, wherein the rotor-type carburetor has a rotor driven by the ingested airstream via an impeller, the rotor including a centrifugal pump for the delivery through at least one lateral fuel discharge bore of a quantity of fuel which is in a constant ratio to the ingested quantity of air and which is dosed for a lean mixture and carries a coaxial atomization ring with an inner wall for receiving the fuel delivered by the centrifugal pump as well as a circumferentially extending spray edge for atomizing the received fuel into the ingested airstream.

Such rotor-type carburetors, also known under the designation "central injection devices", of which a new type of construction is described e.g. in PCT-Application CH No. 84/00068 produce in the induction pipe of the internal combustion engine such a well prepared fuel-air mixture that all the combustion spaces of the latter are always evenly supplied with a unitary mixture and the internal combustion engine may also be operated with extremely lean fuel-air mixtures ($\lambda = 1.3$ and greater), both of which are above all of particular significance in relieving the environment by a reduction of the content of harmful materials in the internal combustion engine exhaust gases according to the so-called lean concept. In a mixture produced in a rotor-type carburetor of the above kind the fuel to air ratio is the same (constant λ) at all r.p.m.s of the internal combustion engine from idling to full load and for given machine plants depends only on the width of the fuel discharge bore of the centrifugal pump contained in the rotor, so that the desired fuel-air ratio can be adjusted only by altering the diameter of the bore. As has been proved, such a rotor-type carburetor makes it possible to determine and set a constant lean mixture λ-value with which the internal combustion engine is satisfactorily operable in the whole operational range with reduced fuel consumption and additionally the pollutant content in the exhaust gases is very low.

It is know that for the operation of an internal combustion engine which is optimal with regard to performance, fuel consumption and freedom from pollutants a fuel to air ratio of variable λ-value (usually in the range of 0.9 to 1.3) is required, and correspondingly in conventional carburetors and fuel injection devices fuel is metered to the ingested air in dependence on the position of the throttle valve, the r.p.m., the external temperature, the temperature of the cooling water and also other external parameters such as air pressure, air humidity, etc. For rotor-type carburetors also the dependence on λ has already been taken into account. Thus, for instance, in U.S. Pat. No. 2,823,906 there is described a rotor-type carburetor, which is admittedly of a somewhat different type of construction from that provided herein, in which a shutter surrounding the rotor provided with an impeller and adjustable to together with the throttle valve bypasses the ingested airstream passed over the impeller into a partial stream dependent on the position of the throttle valve into a bypass duct and so the r.p.m. and with it the quantity of fuel given to the whole ingested airstream is regulated in dependence on the position of the throttle valve. However, such a simple fuel-air ratio correction cannot satisfy modern demands and would, when used in a rotor-type carburetor of the constructional type provided herein, hinder its particularly advantageous mixture preparation.

An aim of the invention is to provide a fuel-air ratio correcting apparatus for rotor-type carburetors of the above-mentioned kind with which the fuel to air ratio of a predetermined lean mixture may be changed to the optimal λ-value in those operating phases and at those operating points of the internal combustion engine which require a richer fuel to air ratio, such as acceleration, full load, start-up and idling at lower temperatures, without harming the prepared mixture achieved by the rotor-type carburetor.

The solution for achievement of this aim according to the invention consists in a fuel-air ratio correcting apparatus in which the lean fuel-air mixture is enriched when and as required by measured parameters or operating conditions of the engine by (a) adding small measured quantities of fuel, preferably by a supplemental pump by injection into the atomizing ring, (b) adding fuel through the centrifugal pump by substracting air from the total airstream going to the engine, or (c) adding fuel through the centrifugal pump by increasing the air velocity for any given volume of air driving the turbine of the rotor, thus increasing fuel added to the given volume.

Briefly summarized, a preferred embodiment of the fuel-air ratio correcting apparatus according to the invention has a regulated fuel injection pump which is controlled from a regulating device to which the control signal generators are connected in one or more of those operational phases and operational points of the internal combustion engine which require a richer fuel-air mixture so that always the quantity of fuel sprayed at the internal wall of the atomization ring of the rotor-type carburetor is accurately measured to correct the λ-valve of the mixture, wherein the fuel dosing is always effected in dependence on at least the most important specific parameters relevant to the operational phase or operational point in question, the external parameters being selected from throttle valve actuation, throttle valve position, r.p.m., external temperature, coolant temperature, oil temperature, air pressure, air humidity, etc.

In principle, the fuel-air ratio correcting device according to the invention corresponds to the known fuel injector of Otto engines in which the formerly mechanically but more recently mainly electronically regulated, spray pump meters fuel into a single cylinder or into the induction pipe of an internal combustion engine. The essential difference consists in that in the conventional fuel injection the whole of the required fuel is passed through the fuel pump and is metered accurately at a relatively high pressure (approximately $8 \times 10^5$ Pa) through the fuel injection nozzle or injection nozzles, while with the fuel-air correcting mechanism the fuel injection pump is required to spray a significantly smaller amount of fuel at the internal wall of the atomizing ring which amount just matches the difference between the instantaneous actual fuel quantities delivered by the centrifugal pump of the rotor and the desired fuel quantity given by the optimal λ-value at that instant and at a significantly lower pressure. Because of these smaller metered quantities of fuel, the fuel-air ratio correcting mechanism may also be used for a very accurate metering of the fuel injection pump of low output and simple construction, which is easily controllable by a similarly relatively simply constructed regulating device, this being advantageous for the operational reliability and price-favorable manufacture of the fuel-air ratio correcting apparatus.

A further advantage of the rotor-type carburetor with a fuel-air ratio correcting apparatus consists in that if the fuel-air ratio correcting device breaks down through a defect in the fuel injection system (pump, regulator) the rotor-type carburetor maintains the internal combustion engine fully operable even if in a less perfect condition, while when a known fuel injection device is damaged, then mostly also the whole internal combustion engine fails. Rotor-type carburetors with fuel-air ratio correcting thus bring an additional operational reliability for motor vehicles.

In accordance with other embodiments of the invention, the fuel-air ratio may be enriched in response to the same measured parameters by reducing the quantity of air passed through the butterfly valve for a given rotational speed of the turbo carburetor. In one embodiment, the air passing through a flow path arranged in parallel to that passing over the turbine device is restricted so that more air flows through the turbine, thus providing more fuel. Alternatively, the velocity of the air flowing past the turbine may be increased by constricting the flow passageway around the turbine, thus providing a richer fuel-air mixture.

Advantageous further embodiments of the subject matter of the invention are given in dependent claims.

A preferred embodiment of the invention is illustrated in the accompanying drawings in which the individual figures illustrate:

Figure 1:
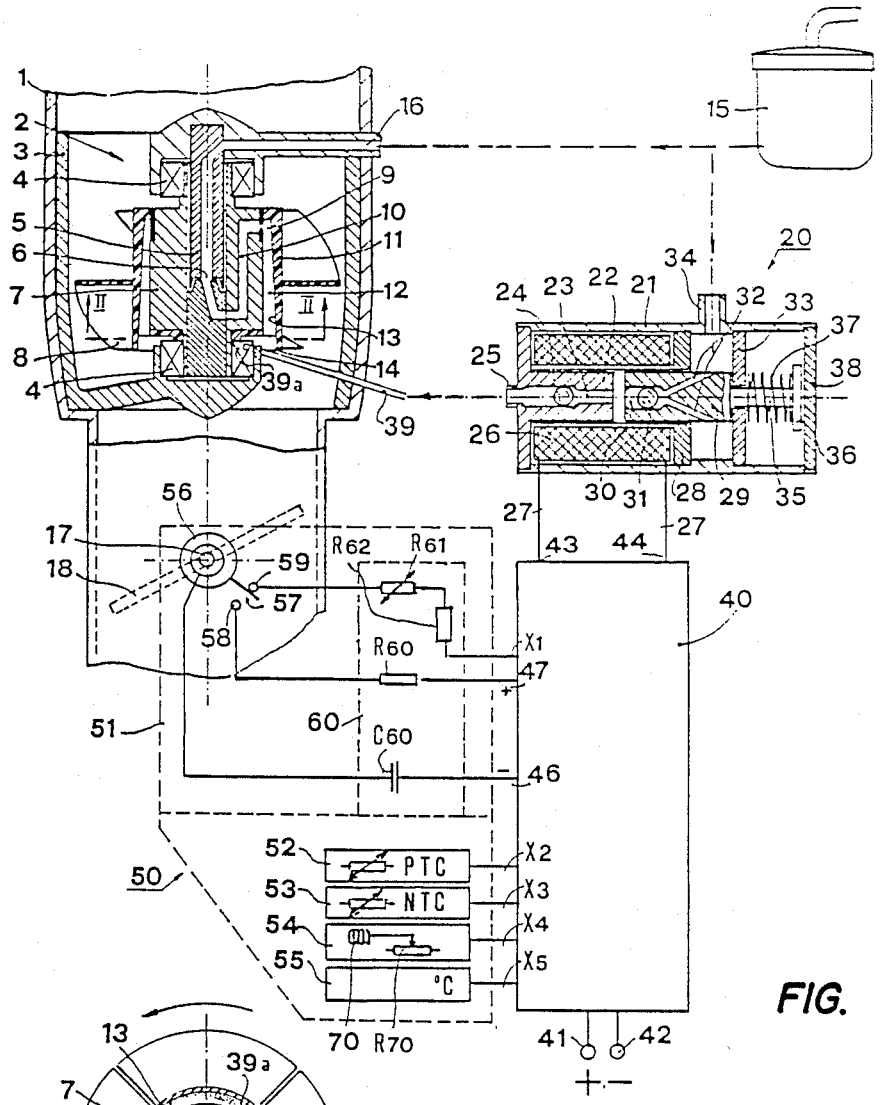
FIG. 1 is a longitudinal section through a rotor-type carburetor of know construction and through an electromagnetically actuated piston pump with a regulating device connected to it, in schematic representation.

The rotor-type carburetor 2 of known construction shown in FIG. 1 schematically in longitudinal section and disposed in the induction pipe 1 of an internal combustion engine consists essentially of a rotor 7 which is journaled for contact-free rotation coaxial fuel supply pipe 5 in a bush 3 in ball bearings 4; the rotor is fitted with an impeller wheel 8 to be driven by the ingested airstream. The rotor 7 contains as a centrifugal pump unit a fuel supply duct 10 which is connected to the discharge opening 6 of the fuel supply pipe 5 in a similarly contact-free manner and leads to a lateral fuel discharge bore 9. The hub of the impeller wheel 8 carrying the vanes forms an atomization ring 11 which as a conically downwardly widening internal wall 13 bounding at the outer surface of the rotor an open annular space 12 which is closed at the top by the fuel discharge bore 9, is open underneath the vanes and terminates in a circumferentially extending spray edge 14, so that the fuel ejected at high pressure from the fuel discharge bore 9 when the rotor 7 rotates is drawn out into a thin film on the internal wall 13 of the atomization ring 11 which rotates with the rotor and is atomized via the spray edge 14 beneath the impeller wheel 8 as a mist of the finest droplets into the ingested airstream. The supply of fuel to the rotor-type carburetor takes place in the conventional manner, e.g., by means of a delivery pump, in which case expediently the rotor-type carburetor is provided with an overflow and fuel recirculating device; or via a float 15, drawn schematically in FIG. 1 without regard to its construction and position in relation to the rotor-type carburetor, the float being connected to the fuel supply pipe 5 of the rotor-type carburetor 2 via a fuel pipe 16. Downstream of the rotor-type carburetor 2, the usual throttle (butterfly) valve 18 is disposed in the air induction pipe 1 of the internal combustion engine, the valve being adjustable or settable about its axis 17 via the throttle or accelerator pedal which is not shown in FIG. 1.

As already explained above, when the rotor 7 rotates fuel is delivered through the fuel discharge bore 9 in a quantity which stands at all r.p.m.s of the internal combustion engine from idling to full load in a constant ratio to the ingested quantity of air, the proportionality factor being determined by the diameter of the fuel discharge pipe 9 which in the present case is so selected that the rotor-type carburetor supplies the internal combustion engine with a lean fuel-air mixture of, preferably, $\lambda = 1.25$.

Figure 2:
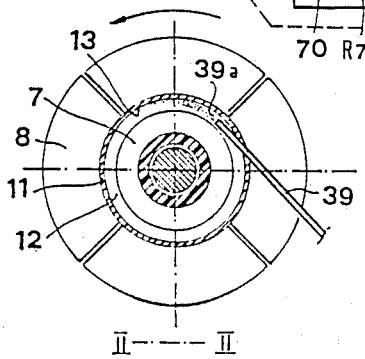
FIG. 2 is a cross-section through the rotor-type carburetor along the line II—II in FIG. 1.

The fuel-air ratio correcting apparatus includes a regulated fuel injection pump 20, the outlet 25 of which is connected to an injection nozzle pipe 39 which, as may be seen more clearly in FIG. 2, extends into the annular space 12 of the rotor 7 and is directed at an inclined angle in the direction of rotation of the rotor 7 at the internal wall 13 of the atomization ring 11, so that fuel is sprayed at the inner wall 13 from the fuel injection nozzle 39*a*, the fuel mixing there with the fuel delivered from the fuel discharge bore 9 of the rotor 7 and is being atomized together with it at the spray edge 14 into the ingested stream of air.

The fuel injection pump 20 may be of any desired form of construction; however, preferably it is an electromagnetically actuatable simply operated piston pump, as shown in FIG. 1. In the illustrated fuel injection pump 20 a cylindrical pump housing 21 one end face of which is covered by a magnetic core 22 and the other end face by a cover 38. The magnetic core 22 has a longitudinal bore 23 lying in the longitudinal axis of the housing which bore goes through to the outlet 25 and has in it an outlet or discharge ball valve 24 and carries a magnetic coil 26. The coil 26 extends from the magnetic core 22 to a magnetic return path ring 28 arranged in the pump housing 21, which together with the front section of the pump housing 21 provides a magnetic return path to the magnetic core 22 to prevent a weakening of the magnetic field. A cylindrical piston pump 29 is arranged for longitudinal displacement in the magnetic return path ring 28 to serve as a magnetic anchor and projects into the magnetic coil 26, being displaceable between the magnetic core 22 and a closure ring 33 mounted in the pump housing 21 at a distance from the magnetic return path ring 28. On its end facing the magnetic core 22 the piston pump 29 has a coaxial bore 30 containing an inlet ball valve 31 and connected e.g. with the inlet 34 of the fuel injection pump 20 connected to the fuel duct 16, via inlet ducts 32 leading obliquely to outer surface of the piston and through the pump chamber 34 between the magnetic return path 28 and the closure ring 33. On its end face remote from the magnetic core 22 the piston pump 29 carries a rod 35 which is journaled in the closure ring 33 for ready displacement and which is fitted at its free end with a plate 36 serving as an abutment for a return spring 37 for the piston pump 29 supported at the closure ring 33. An undesired ejection of fuel from the pump housing 21 is prevented by means of a lid 38 mounted on the housing.

The fuel injection pump 20 is designed for uniform piston strokes of preferably 1.2 mm and independently of the actual mode of construction is so dimensioned that for each pump stroke a constant amount of fuel, e.g. between 40 and 60 $mm^3$ is sprayed via the spray nozzle 39*a* into the atomization ring 11 or the rotor 7. In addition, the fuel injection pump 20 is also so constructed that practically no wear occurs over extended operational periods and thus above all the fuel quantity expelled per pump stroke is always constant and no adjustments are required.

The fuel injection pump 20 illustrated in FIG. 1 is driven by current pulses of constant amplitude and variable pulse repetition frequency, so that with each current pulse a pump stroke takes place and through the pulse repetition frequency the additional fuel quantity delivered per unit of time by the fuel injection pump 20 into the atomization ring 11 is determined for effecting a correction of the λ-value. The current pulses are produced by a pulse generator 40 the outputs 43, 44 of which are connected to the magnetic coil 26 of the fuel injection pump 20 via connecting leads 27. The pulse generator 40 receives operational direct voltage from terminals 41, 42 and produces at its outputs 43, 44 current pulses with a repetition frequency which is dependent on control signals at control inputs $X_1,X_2,X_3,X_4,X_5$ . . . . Electronic control signal generators 51, 52, 53, 54, 55 are connected to the control inputs $X_1,X_2$ . . . of the pulse generator 40, of which each is a measuring element or transducer for an external parameter and, when required, includes a circuit arrangement connected thereto for converting the signals given by the transducers into a control signal for the pulse generator 40. The control signal generators 51, 52, 53, 54, 55 . . . together with the pulse generator form the regulating device 50 for the regulated fuel injection pump 20. The fuel-air ratio correcting apparatus shown in FIG. 1 serves the control signal generator 51 for fuel-air ratio correction on acceleration of the internal combustion engine, while the other control signal generators 52, 53, 54, 55 serve e.g. for fuel-air ratio correction at cold start, hot start, in dependence on the air pressure and in dependence on the external temperature. Any desired additional number of signal generators with transducers may be connected, such as particularly for effecting fuel-air ratio correction in dependence e.g. on the oil temperature, the r.p.m., the output etc.

Figure 3:
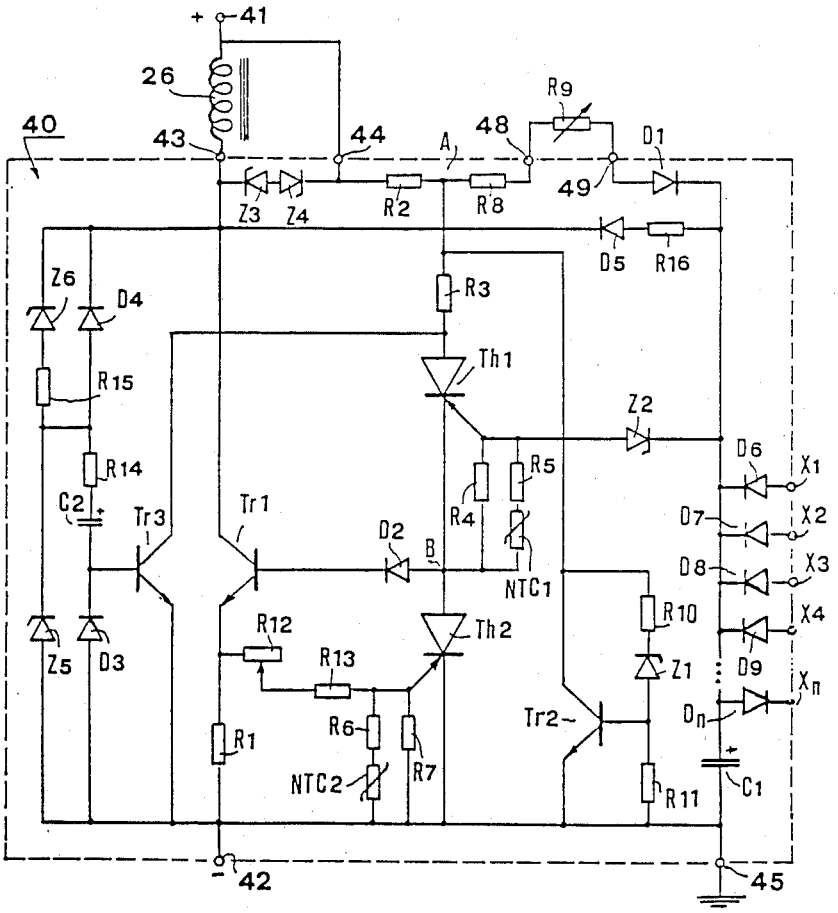
FIG. 3 is a circuit diagram for a pulse generator forming part of the regulating device in FIG. 1.

A particularly simple circuit arrangement for such a signal generator 40 is shown in FIG. 3. In this circuit arrangement the magnetic coil 26 of the fuel injection pump 30 (FIG. 1) in the pulse generator 40 is connected at one end via the signal generator output 43, the collector-emitter path of a switching transistor Tr1 (e.g. BD 243) and a resistor R1 (0.68 Ohm) with the negative terminal 42 of the supply voltage source (10–15 volts) and at the other end via the pulse generator output 44 directly with the positive terminal 41 of the supply voltage source, so that for each rapidly succeeding switching-on and off of the switching transistor Tr1 a current pulse is produced to flow through the magnetic coil 26 representing an inductive load. To switch the switching transistor Tr1 (first transistor) on and off its base is connected via a diode D2 with a junction B of two series-connected thyristors Th1 and Th2 of which the anode of the first thyristor Th1 is connected via a resistor R3 (120 Ohms) with a junction A leading to a stabilized voltage of e.g. 8.6 volts and connected via a resistor R2 (56 Ohm) to the positive terminal of the operational voltage source, and the cathode of the second thyristor Th2 is connected with the negative terminal 42 of the operational voltage source. To stabilize the voltage at circuit junction A there is provided a conventional stabilizing circuit connected thereto and consisting of a second transistor Tr2, a Zener diode Z1 and resistors R10 (12 Ohm) and R11 (470 Ohm), all connected as shown in FIG. 3.

With the second thyristor Th2 biased off, the first thyristor Th1 is caused to fire and so the switching transistor Tr1 is switched into conduction by a base current flowing through the resistors R2 and R3, the first thyristor Th1, the base-emitter path of the transistor Tr1 and the resistor R1, and a flow of current occurs through the magnetic coil 26, the collector-emitter path of the switching transistor Tr1 and the resistor R1. When thereafter the second thyristor Th2 also fires, then the base current flowing to the base of the switching transistor Tr1 is led off through the second thyristor Th2 which is now switched into conduction, and the switching transistor Tr1 is biased off. The period from the firing of the first thyristor Th1 to the firing of the second thyristor Th2 essentially determines the duration of the current pulse flowing through the magnetic coil 26; in the preferred embodiment described herein the duration of the current pulse is selected to be approximately 4 msec, in which 4 msec the piston pump 29 (FIG. 1) is pushed from is rest position towards the magnetic core 22 against the force of the return spring 37 to effect a pump stroke of 1.2 mm length and the fuel given by the pump volume is sprayed into the atomization ring 11.

To fire the first thyristor Th1, its ignition electrode is connected via a Zener diode Z2 (4.7 volts) with the positive electrode of the first capacitor (22 uF) in which the negative electrode of the capacitor is connected to the negative terminal 42 of the operational voltage source which is earthed via an earth connection 45. The positive plate or electrode of the first capacitor C1 is connected for charging the capacitor via a diode D1 and a charging resistor R9 (4.7 kOhm) to the junction point A, and for discharging through a discharging resistor R16 (100 Ohm) and a diode D5 to the collector of the switching transistor Tr1. The first capacitor C1 and the charging resistors R8, R9 form an RC member of adjustable time constant. When the pulse generator is switched on, i.e. when the operational voltage is supplied, the first capacitor C1 begins to charge up and as soon as its voltage reaches the Zener voltage of the Zener diode Z2, the first thyristor Th1 will fire, while the series circuit consisting of resistor R5 (680 Ohm) and a negative temperature coefficient resistor R4 (2.2 kOhm) makes the firing independent of temperature fluctuations. As soon as the switching transistor Tr1 is switched on by firing of the first thyristor Th1 and the current flows through the magnetic coil 26 and the switching transistor Tr1, the first or RC-member capacitor C1 is discharged via the discharge resistor R16 connected with the collector of the switching transistor Tr1. The discharge of the first capacitor C1 must be completed before the switching-off of the switching transistor Tr1 by the firing of the second thyristor Th2.

In order to fire the second thyristor Th2 its ignition electrode is connected via a fixed resistor R13 (330 Ohm) and a regulating resistor R12 or trimmer (500 Ohm) with the emitter of the switching transistor Tr1 connected to the resistor R1, wherein here also in order to make the firing independent of temperature fluctuations, the resistor R7 (1 kOhm) has a parallel connection or shunt at the firing electrode in the form of a series connection made up of fixed resistor R6 (1 kOhm) and a negative temperature coefficient resistor NTC2 (4.7 kOhm, 20° C.). When through firing of the first thyristor Th1 the current begins to flow through the magnetic coil 26, the switching transistor Tr1 (which has been switched into conduction) and the resistor R1, the voltage drop at resistor R1 produces at the emitter a voltage which rises with the current and which is applied via the trimmer R12 and the resistor R13 to the ignition electrode of the second thyristor Th2. As soon as the voltage rises to the ignition voltage (1 volt) of the second thyristor, the latter fires. The circuit components here are so dimensioned that the second thyristor Th2 fires when the current through the magnetic coil 26 rises to 1.5 Amps. With this circuit arrangement current pulses of a constant amplitude of 1.5 Amp are thus produced with a constant pulse duration of 4 msec, with the pulse separation and thus the pulse repetition frequency being determined by the charging time of the first capacitor C1 and which are adjustable by the regulating resistor R9 connected into the charging circuit, as so far described.

Before a subsequent current pulse can be triggered, both of the thyristors Th1 and Th2 must be extinguished. When the switching transistor Tr1 is switched off the magnetic energy stored in the magnetic coil 26 during current flow causes at the collector of the switching transistor Tr1 an induction voltage of short duration (approximately 2 msec) opposing the supply voltage, which is limited by the Zener diodes Z3 and Z4 (36 volts) connected in parallel with the magnetic coil 26 to a value (36 volt) which is harmless for the switching transistor Tr1. This induction voltage is used for extinguishing the thyristors Th1 and Th2.

The resetting or extinction circuit contains here a third transistor Tr3 (BC 337, 60 volts), the collector-emitter path of which is connected in parallel to the series-connected thyristors Th1 and Th2. The base of the third transistor Tr3 is connected on the one hand via a diode D3 (100 volts) with the negative terminal 42 of the operational voltage source and on the other hand via an RC series circuit consisting of a capacitor C2 (1 F) and resistor R14 (270 Ohm), as well as a resistor R15 (1 kOhm) and a Zener diode Z6 (6.2 volts) with the collector of the switching transistor Tr1. The series circuit consisting of diode D3 and the RC series member C2, R14 is connected in parallel to a Zener diode Z5 (8.2 V) while the series circuit consisting a resistor R15 and Zener diode Z6 is connected in parallel to a diode D4 (100 V) as shown in FIG. 3. Directly after switching off the switching transistor Tr1 current flows from the collector of the switching transistor Tr1 through the Zener diode Z6, the resistor R15, the RC series member R14, C2 and the base-emitter section of the third transistor Tr3 until the capacitor C2 is charged up, which takes about 1.5 msec. The third transistor Tr3 is thereby switched into conduction for a short time and the voltage at the anode of the first thyristor Th1 collapses so that both thyristors Th1 and Th2 are extinguished. When for the next current pulse the switching transistor Tr1 is switched into conduction by firing of the first thyristor Th1, the second capacitor C2 discharges via the diode D3 and the series connection consisting of resistor R14 and diode D4 so that the next extinction of the thyristors Th2 and Th2 can take place after this subsequent current pulse. The Zener diode Z5 serves as a limiting diode.

In what follows fuel-air ratio corrections for certain operational points and phases of an internal combustion engine will be described in greater detail.

Fuel-air ratio correction for optimal idle running of an internal combustion engine:

The regulating resistor R9 connected in the charging circuit of the first capacitor C1 serves for adjusting an optimal λ-value for the idle running of the internal combustion engine. In idling, the internal combustion machine has a very low fuel consumption of about 500 $cm^3$ per hour. In the low idling r.p.m. the rotor 7 also rotates at a low r.p.m. and correspondingly the fuel ejection through the fuel discharge bore 9 of the rotor 7 is low. Hence to achieve an optimal λ-value for idle running very little additional fuel delivered by the fuel injection pump 20 of the rotor 7 is required so that for instance one pump stroke per second or more and thus a repetition frequency of 1 Hz or less for the current pulses driving the fuel injection pump 20 are fully sufficient. This idling pulse repetition frequency is adjusted at the regulating resistor R9 and the thus adjusted regulating resistor R9 may remain connected in the charging circuit of the first capacitor C1 for all r.p.m.s of the internal combustion engine since this very low amount of additional fuel can scarcely influence the lean mixture λ-value adjusted by the fuel discharge bore 9 in the load ranges of the internal combustion engine at the considerably higher fuel consumptions prevailing there; moveover, this can be taken into account in dimensioning the fuel discharge bore 9 to the desired lean mixture. Accordingly in this preferred embodiment of a correction apparatus the idling fuel-air ratio correction is already built into or integrated in the pulse generator.

Cold Start:

To start an internal combustion engine at lower temperatures requires a very rich fuel-air ratio. Hence for the correction at this operational point of the internal combustion engine the fuel injection pump 20 should deliver much fuel to the rotor 7 and should be driven with a correspondingly higher pulse repetition frequency, wherein the pulse repetition frequency should in addition be regulated in dependence on the temperature, particularly that of the coolant. The control signal generator 52 (FIG. 1) for the cold start fuel-air ratio correction has a transducer a positive temperature coefficient resistor arranged in the coolant with a characteristic curve which matches the desired fuel-air ratio correction or which is made to match it by a circuit connected thereto. This control signal generator 52, in the simplest case a PTC resistor, in connected in parallel with the regulating resistor R9 by connecting it to the terminal 48 of the pulse generator 40 (FIG. 3) and to the control input X2 which is connected via a diode D7 with a positive electrode of the first capacitor C1, whereby over the shorter charging times of the first capacitor C1 for the operation of the fuel injection pump 20 in this temperature range pulses of higher repetition frequency regulated in dependence on the coolant temperature are obtained. In order to make the cold start fuel-air ratio correction operative only in a cold start temperature range, an electronic circuit may be provided which is controlled e.g. by a temperature sensor arranged in the coolant and which at an upper temperature threshold value switches the control signal generator 52 out of the charging circuit of the first capacitor C1.

Hot Start:

It is well known that to start a hot internal combustion engine, such as for instance a motor vehicle which after a longer journey stands in the blazing sun and beneath the engine hood or bonnet a high temperature prevails because of a heat dam, is very difficult. It has been shown that by using a richer fuel-air mixture hot start becomes problem-free. Accordingly, the same circumstances or relations apply as for cold start but with the difference that for cold start the fuel supplied to the rotor must increase with dropping temperature while for hot start the amount of fuel is to be increased with rising temperature. In order to achieve the higher, and with increasing temperature, increasing pulse repetition frequency, the control signal generator 53 (FIG. 1) contains for the hot start correction a NTC resistor which my be arranged at any desired position under the engine hood or bonnet and, as for the cold start fuel-air ratio correction, is connected to the terminal 48 of the pulse generator 40 (FIG. 3) and to the control input $X_3$ which is connected via a diode D8 with the first capacitor C1 to form a parallel charging circuit to the regulating resistor 9. In other respects the hot start control signal generator 53 may be formed as the cold start signal generator 52 and in particular may also be disconnected by an electronic switch from the charging circuit of the first capacitor C1 when the engine temperature drops below a lower temperature threshold value.

Fuel-air ratio correction as acceleration:

To accelerate the internal combustion engine the gas pedal is depressed to open the throttle valve 18 (FIG. 1), whereby to obtain the richer fuel-air mixture required for acceleration and a sufficient quantity of additional fuel is delivered by the fuel injection pump 20 to the rotor 7. A simple control signal generator 51 for effecting fuel-air ratio correction on acceleration is shown in FIG. 1. The throttle valve shaft 17 carries a friction coupling 56 by means of which on opening the throttle valve 18 the movable contact 57 of an electric change-over switch 57, 58, 59 is set from one fixed contact 58 to the other fixed contact 59. The change-over switch 57, 58, 59 is connected via a circuit 60 with the pulse generator 40, one of the fixed contacts 58 being connected via a charging resistor R60 (10 kOhm) with one terminal 47 leading to a positive voltage of 8.2 volts (e.g. from terminal 43 in FIG. 3), the movable contact 57 is connected via capacitor C60 (22 mF) with one earth terminal 46 and the other fixed contact 59 is connected via a series circuit consisting of the regulating resistor R61 (1 kOhm) and a fixed resistor R62 (220 Ohm) with the control input X1 (FIG. 3) and a diode D6 connected thereto with a positive electrode of the first capacitor C1. The distance between the two fixed contacts is chosen to be as small as possible so that the change-over switch reacts to extremely small displacements of the throttle valve. On movement of the throttle valve to the closure position, e.g. when acceleration is removed, the movable contact 57 is set to the fixed contact 58 and the capacitor C60 is charged. On depressing the accelerator pedal, i.e. on giving gas, when the throttle valve 18 is moved towards the open position, the movalbe contact 57 is set to the other fixed contact 59 and the capacitor C60 gives up its energy via the regulating resistor R61, the fixed resistor R62 and the diode D60 to the first capacitor C1 of the pulse generator 40. When the regulating resistor R61 is set or adjusted to 1 kOhm then the first capacitor C1 of the pulse generator 40 is charged in 0.2 seconds approximately 14 times and the first thyristor Th1 fires via the Zener diode Z2 (FIG. 3) for the same number of current pulses; when in contrast the regulating resistor R61 is set to 0 Ohm, then the first capacitor C1 of the pulse generator 40 is charged three times in 0.05 seconds. In this way the quantity of fuel additionally to be sprayed by the fuel injection pump to accelerate the internal combustion engine may be vary accurately metered.

The resistance of charging resistor R60 is selected to be high so that during a movement of the throttle valve of short duration during which the fixed contact 58 is merely touched by the movable contact 57, the capacitor C60 is only charged to a very small extent. A particular advantage of such a control signal generator 51 for fuel-air ratio correction during acceleration consists in that already by a small opening of the throttle valve practically immediately the fuel-air mixture is enriched with fuel so that the reaction speed is very high.

When it is expedient to maintain the enrichment of the mixture with fuel for accelerating the internal combustion engine over a longer time, e.g. during 4 seconds, then for instance the movable contact 57 of the change-over switch may be connected with a constant voltage source and the charging current path R61, R62 to the control input X1 may additionally contain a controlled switch member for a 4 second switching time which will only be triggered when the movable contact 57 makes contact for a predetermined minimum time with a fixed contact 59 and thus the initiation of a pulse train on mere touch of the fixed contact is prevented.

Fuel-air correction in dependence on air pressure:

With such a fuel-air ratio correction, when a motor car travels over valleys and mountains, the right or correct mixture is always adjusted and the further advantage is obtained that the rotor-type carburetor need only be set for a particular geographical height, e.g. sea level, and each change in height is automatically taken into account in the formation of the mixture.

The control signal generator 56 (FIG. 1) for the air pressure-dependent fuel-air ratio correction contains a variable resistor R70 adjustable by a barometric transducer 70 which is connected between the terminal 48 of the pulse generator 40 (FIG. 3) and a control input $X_4$ connected with the first capacitor C1 via a diode D9, as a parallel charging circuit to the control resistor R9.

In general, fuel-air ratio correction for idle-running, hot start, cold start, acceleration and in dependence on air pressure is fully sufficient. For still more precise dosing, as already mentioned above, further dependencies may be introduced. With the described control signal generators 51, 52, 53, 54 a richer fuel-air mixture is obtained and it may happen that on introducing a further dependency, the mixture must again be made leaner. To this end, the charging current flowing to the first capacitor C1 may be connected to a control signal generator which is e.g. connected to the control input $X_n$ (FIG. 3) and also connected with the positive electrode of the first capacitor C1 via the diode $D_n$ of opposite polarity whereby to provide a branch current. As with the already described control signal generators 52, 53, 54, this control signal generator may contain an adjustable resistor which can be adjusted in dependence on an operating parameter so that a partial current may be drawn which is regulated in dependence on this operating parameter and the repetition frequency of the pulse train produced by the pulse generator 40 is correspondingly reduced.

It should be noted that on injecting fuel from the injection nozzle pipe 39 at an inclination to the direction of rotation of the rotor at the internal wall 13 of the atomization ring 11 (FIG. 3) the impeller-driven rotor 7 will be accelerated when the velocity of the injected fuel is greater than the angular velocity of the rotor, so that as a consequence of the higher r.p.m. the fuel-air mixture will be additionally enriched with fuel. This acceleration arises particularly in the lower idling r.p.m. range and the thus enhanced fuel delivery may without further steps be compensated with the adjusting resistor R9 of the idling fuel-air ratio correction. When the velocity of the injected fuel is less than the rotor r.p.m., the rotor will be braked and as a consequence of the lower r.p.m. a somewhat leaner mixture is obtained. In general, such acceleration and braking effects have no significance for fuel metering but may for a very precise fuel dosing be disturbing. With the above described pulse generator 40 it is possible without difficulty to reduce these effects by an r.p.m.-dependent regulation of the injection pressure at least to a harmless value. To this end, for instance, the switching off of the switching transistor Tr1 (FIG. 3) may be regulated in an r.p.m.-dependent manner by making e.g. the resistor R1 and/or the adjustable resistor R12 variable through an r.p.m. transducer so that the pulse generator 40 produces current pulses with amplitude and pulse length regulated in dependence on the r.p.m.

As shown by the above example, the fuel-air ratio correcting apparatus according to the invention enables every desired accuracy in the fuel dosing to be achieved, wherein the costs to achieving a greater accuracy are relatively low. To this increased accuracy one should add also that the injection nozzle pipe 39 projects into the atomization ring 11 and the injection nozzle 39*a* is shielded from the ingested airstream by the ring so that no fuel will be sucked out of the injection nozzle pipe 39 and fuel delivery takes place exclusively through the regulated fuel injection pump 20.

The regulating apparatus 50 is not restricted to the embodiment described above and may be varied as desired, not least by a cost-favorable construction utilizing integrated circuit chips obtainable in commerce.

Figure 4:
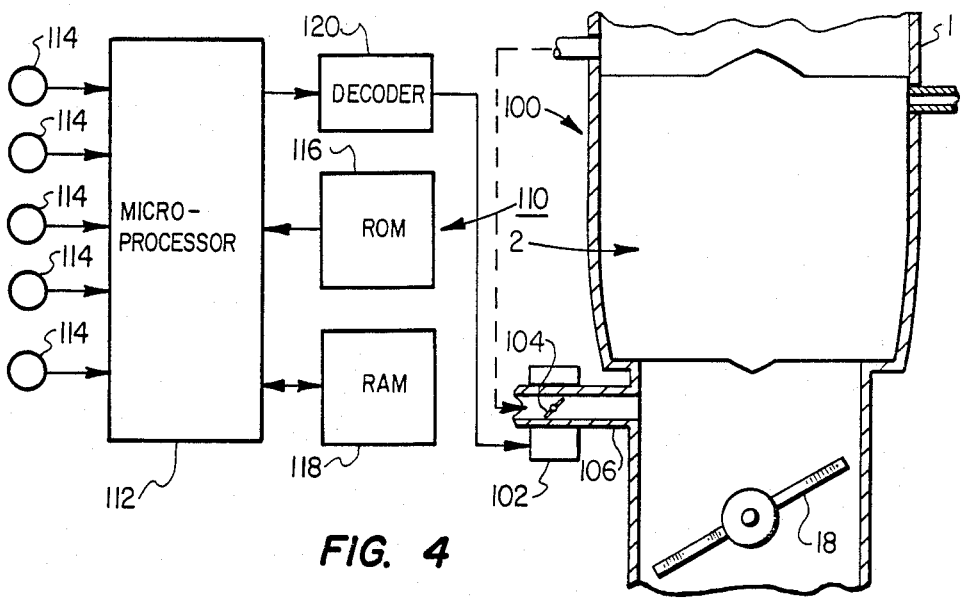
FIG. 4 is schematic diagram of an alternative embodiment of a system including a controller for correcting the fuel-air mixture in accordance with the present invention.

Referring now to FIG. 4, an alternative embodiment of a system for correcting the fuel-air ratio in accordance with the present invention is indicated generally by the reference numeral 100. The device 100 includes the rotor type carburetor 2 which may substantially be identical to that illustrated in FIG. 1 except for the size of the fuel metering orifice 9 which was heretofore described in greater detail. The carburetor 2 is disposed in the induction pipe 1 leading to the induction manifold of the engine as heretofore described which includes a conventional throttle actuated butterfly valve 18 disposed in the intake pipe downstream of the rotor-type carburetor 2. An electrically controlled bypass valve, indicated generally by the reference numeral 102, controls the passage of the air through a conduit 104 leading to the induction pipe 1 at a point downstream of the rotary carburetor 2 and upstream of the butterfly valve 18. The conduit 104 may conveniently lead from any source of gas, which includes some active oxygen, but preferably air, and typically may come from within the air filter system as represented by the dotted lines leading to the induction tube upstream of the carburetor 2. The effect is that the passageway 104 is connected in parallel with the passageway 1 in which the carburetor 2 is disposed. The valve 102 is preferably spring-biased into the full open position.

The carburetor 2 is designed to provide a fuel dosing which would produce the desired most lean fuel-air mixture when the butterfly 104 of the valve 102 is in the full open position. This can be achieved by merely increasing slightly the diameter of the metering orifice 9 to provide a slightly greater quantity of fuel for a given rotary speed of the rotor-type carburetor as compared to that where all induction air is passed over the turbine blades, thus compensating for the supplemental flow of air through the parallel passageway 106, which both dilutes the final induction air to the engine and also increases the volume of air passing through the carburetor turbine for a given engine speed thus increasing the quantity of fuel ultimately broadcast into the airstream. The valve 102 thus provides a means for increasing the fuel-air ratio in proportion to the closure of the valve 104. This is due to the fact that the total air passing through the butterfly 18 to the engine is determined by the r.p.m. of the engine, which must be provided by both the passageway 106 and the turbine driving air passing through the carburetor 2. Thus, when the valve 102 is full open, the speed of rotation of the carburetor 2 is reduced for any given quantity of air passing through the throttle valve 18, thus injecting the minimum quantity of fuel needed for the desired lean mixture operation of the engine. Conversely, when the valve 104 is fully closed, all induction air to the engine must pass by the rotor of the carburetor 2, increasing the velocity of the air and thus the rotational speed of the turbine, in turn increasing the amount of fuel added to the total induction airstream passing through the throttle valve 18 into the engine, and thus providing a richer mixture.

Figure 5:
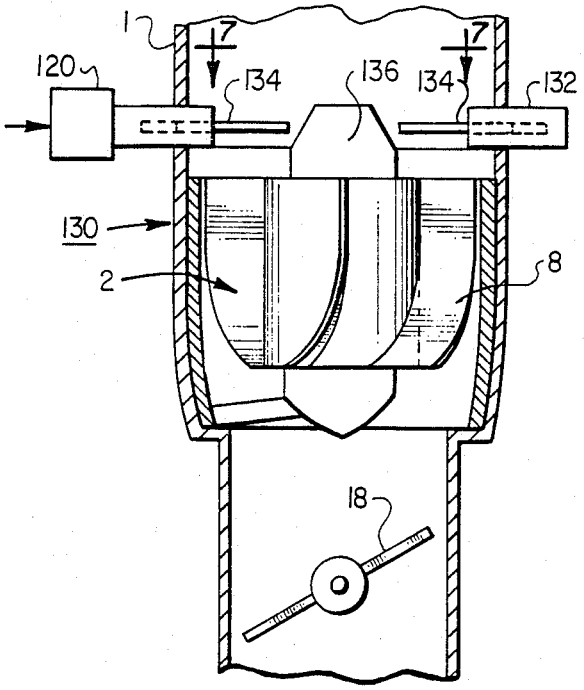
FIG. 5 is a simplified sectional view of an another embodiment of the present invention which may be used in connection with the controller circuit of FIG. 4.

The valve 102 may be operated by any suitable analog or digital system of the general type represented in FIGS. 1 and 3, previously described, or may be of the type disclosed generally in FIG. 5 and indicated by the reference numeral 110. The device 110 includes a microprocessor 112 which receives signals from one or more sensors 114 which detect parameters affecting the operation of the engine. The microprocessor is controlled by the program stored in a read only memory 116 and utilizes a random access memory 118 for data processing, all in the conventional manner. The calculated fuel-air mixture is passed through a decoder 120 which, in turn, controls the air controller valve 102 to move the butterfly 104 to the proper position to achieve a fuel-air mixture corresponding to that calculated for the particular moment of operation.

Figure 6:
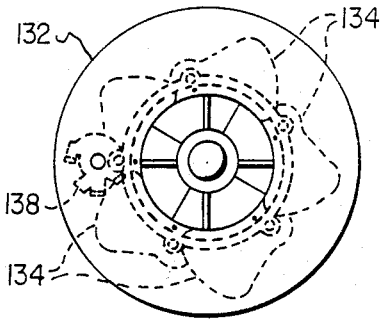
FIGS. 6 and 7 are somewhat schematic top views of a portion of the mechanism of FIG. 5, taken substantially on lines 7—7 of FIG. 5.
Figure 7:
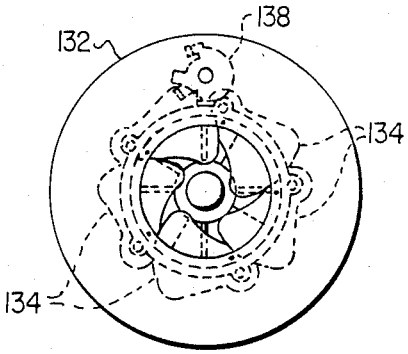

Still another embodiment of the present invention is indicated generally by the reference numeral 130 in FIG. 5. The system 130 includes the same turbo carburetor 2 disposed in the induction passageway 1 which also includes the downstream throttle operated butterfly valve 18 as heretofore described. The embodiment 130 is further characterized by an air controlling device indicated generally by the reference numeral 132 positioned immediately adjacent the inlet to the rotary carburetor for increasing the velocity of any given volume of air over the turbine blades 8. The device 132 may be a iris control or shutter type device such as typically used in cameras for constricting the opening leading to the blades 8 of the rotor of the carburetor. Thus, the movable leaves 134, illustrated in dotted outline in FIG. 6, may be moved by the actuator 138 from the fully closed position illustrated in FIG. 7, or to any degree of partial closing therebetween. The movement of the blades 134 inwardly toward a conical shaped ferring 136 has the effect of increasing the velocity of substantially the same volume of air, as compared to the full open position, passing over the rotor blades 8. This increases the rotational speed of the turbine driven rotor assembly 2, thus providing additional fuel into the driving airstream passing through the carburetor 2. Since the total amount of induction air to the engine is determined by the throttle controlled butterfly valve 18, the effect of this increased air velocity is to enrich the fuel-air ratio. Thus, when the actuator 120 for the constricting device 132 is controlled in response to the output from the decoder 120 of the control system 110, the fuel-air ratio of the gas entering the engine may be incrementally increased, or corrected, to correspond to that calculated as desirable by the microprocessor of the controller 110. Of course, other mechanisms may be used to increase the velocity of the driving airstream as it flows past the rotors to correct the fuel-air ratio as required.

Although preferred embodiments of the invention have been described in detail, it is to be understood that various changes and alterations can be made therein without departing from the spirit and scope of the invention as defined by the appended claims.

What is claimed is:

1. Fuel-air ratio correcting apparatus in a rotor-type carburetor for internal combustion engines with spark ignition for producing ingestion air with fuel-air ratios within a predetermined range defined by lean and rich limits matched to the requirements of the various operational points of the internal combustion engine, wherein the rotor-type carburetor has a rotating element including a turbine which is driven by a turbine driving airstream which is induced by the engine and which becomes at least a portion of the ingested air stream, the rotating element containing a centrifugal pump for delivering a quantity of fuel which is in a substantially constant ratio to the rotational velocity of the rotating element, the fuel being delivered to a coaxial, centrifugal atomization means, carried on the rotating element for rotation therewith, for broadcasting atomized fuel into the driving airstream, the centrifugal pump being sized to deliver a quantity of fuel to the driving airstream to establish a fuel-air ratio at one limit of the predetermined range, and means for sensing one or more parameter(s) affecting operation of the internal combustion engine and for selectively varying the volume of at least one of the constituents of the fuel-air mixture ingested by the engine for establishing a predetermined fuel-air ratio variable over the remainder of the range of fuel-air ratios in dependence on one or more measured operating parameter(s) of the internal combustion engine, the rotating element components being designed to produce a fuel-air ratio between the fuel delivered by the rotating element and the ingested air driving the rotating element which is at the lean limit of the range of fuel-air mixtures, and additional fuel being added to the ingested fuel-air stream to establish other fuel-air ratios within the range by an additional injection pump and being passed through the centrifugal means for atomizing the fuel as it is broadcast into the driving airstream.

2. Fuel-air ratio correcting apparatus in a rotor-type carburetor for internal combustion engines with spark ignition for producing ingestion air with fuel-air ratios within a predetermined range defined by lean and rich limits matched to the requirements of the various operational points of the internal combustion engine, wherein the rotor-type carburetor has a rotating element including a turbine which is driven by a turbine driving airstream which is induced by the engine and which becomes at least a portion of the ingested air stream, the rotating element containing a centrifugal pump for delivering a quantity of fuel which is in a substantially constant ratio to the rotational velocity of the rotating element, the fuel being delivered to a coaxial atomization means on the rotating element for broadcasting atomized fuel into the driving airstream, the centrifugal pump being sized to deliver a quantity of fuel to the driving airstream to establish a fuel-air ratio at one limit of the predetermined range, and means for sensing one or more parameter(s) affecting operation of the internal combustion engine and for selectively varying the volume of at least one of the constituents of the fuel-air mixture ingested by the engine for establishing a predetermined fuel-air ratio variable over the remainder of the range of fuel-air ratios in dependence on one or more measured operating parameter(s) of the internal combustion engine, the fuel-air ratio being selectively adjusted from the lean end of the range toward the rich end of the range by means for selectively increasing the velocity on a given volume of driving airstream over the turbine to thereby increase the volume of fuel delivered by the centrifugal pump relative to the volume of the driving airstream to thereby enrich the fuel-air ratio.

3. Fuel-air ratio correcting apparatus in a rotor-type carburetor for internal combustion engines with spark ignition for producing ingestion air with fuel-air ratios within a predetermined range defined by lean and rich limits matched to the requirements of the various operational points of the internal combustion engine, wherein the rotor-type carburetor has a rotating element including a turbine which is driven by a turbine driving airstream which is induced by the engine and which becomes at least a portion of the ingested air stream, the rotating element containing a centrifugal pump for delivering a quantity of fuel which is in a substantially constant ratio to the rotational velocity of the rotating element, the fuel being delivered to a coaxial atomization means on the rotating element for broad-casting atomized fuel into the driving airstream, the centrifugal pump being sized to deliver a quantity of fuel to the driving airstream to establish a fuel-air ratio at one limit of the predetermined range, and means for sensing one or more parameter(s) affecting operation of the internal combustion engine and for selectively varying the volume of at least one of the constituents of the fuel-air mixture ingested by the engine for establishing a predetermined fuel-air ratio variable over the remainder of the range of fuel-air ratios in dependence on one or more measured operating parameter(s) of the internal combustion engine, the rotor-type carburetor having a rotor driven via an impeller by the ingested air stream, the rotor containing a centrifugal pump for delivering via at least one lateral fuel discharge bore (9) a quantity of fuel which is in a constant ratio to the ingested air and which is dimensioned for a lean mixture, the rotor carrying a coaxial atomization ring (11) with an inner wall (13) for receiving the fuel delivered by the centrifugal pump, as well as an annular spray edge (14) for atomizing the fuel received in the injected air stream, characterized by a controlled fuel injection pump (20) the outlet (25) of which is connected to deliver fuel into the atomization ring (11), and by a regulating device (50) for controlling the fuel injection pump (20) and by which the fuel injection pump (20) and the control device (50) are dimensioned and fixed, in order to set the fuel-air ratio of the lean mixture to the fuel-air ratio predetermined for the operating point of the internal combustion engine by delivery to the atomization ring (11) of corrective amounts of fuel the quantity of which is regulated in dependence on one or more operating parameter(s) of the internal combustion engine.

4. A rotor-type carburetor for mixing fuel and air to form a fuel-air mixture ingested by an engine, comprising:

wall means for forming an air flow passage adapted to receive a throughflow of engine-ingested combustion air;

turbine rotor means mounted in said air flow passage for driven rotation therein by air flowing therethrough;

centrifugal atomization means, carried by said turbine rotor means for rotation therewith, for receiving the fuel through first and second separate passages, atomizing it, and centrifugally discharging the atomized fuel into said air flow passage for mixture with air flowing therethrough; and injection pump means for injecting at least a portion of the fuel through one of said separate passages into said centrifugal atomization means for atomization and discharge thereby to selectively vary the fuel-air ratio of the carburetor.

5. The rotor-type carburetor of claim 4 wherein:

said centrifugal atomization means include a spray ring coaxially carried by said turbine rotor means, said injection pump means include a fuel injection pump adapted to inject fuel into the interior of said spray ring during rotation thereof, and said rotor-type carburetor further comprises control means for controlling the quantity of fuel delivered to the interior of said spray ring to selectively vary the fuel-air ratio of said rotor-type carburetor in a predetermined manner in response to variation in at least one operating parameter of the engine.

6. Fuel-air ratio correction apparatus according to claim 3, characterized in that the fuel injection pump is an electrically actuated displacement pump with adjustable delivery volume and the adjusting device contains an electric control signal generator for adjusting the delivery output in dependence on one or more operating parameter(s) of the internal combustion engine, particularly the r.p.m., load, coolant temperature, oil temperature, engine temperature, external temperature, air pressure, air humidity, throttle valve position and throttle valve movement.

7. Fuel-air ratio correcting apparatus according to claim 6, characterized in that the fuel injection pump is an electromagnetically actuated simply operating piston pump (20) with a magnetic coil (26) excited by current pulses, performing a full pump stroke for each current pulse, and the regulating device (50) is a pulse generator (40) connected to the magnetic core (26) for producing pulses of variable pulse repetition frequency regulated by the control signal generators(s) (51, 52, 53, 54, 55).

8. Fuel-air ratio correction apparatus according to claim 7, characterized in that the pulse generator (40) includes an electronic switch, particularly a switching transistor (Tr1) through which the magnetic coil (26) of the fuel injection pump is connected to a source of DC current in order to produce a current pulse for each successive switching on and off of the switch, the latter being connected to a timing member adjustable by the control signal generator(s) (51, 52, 53, 54, 55) for producing regulated repetition frequency at a trigger circuit (Th1, Th2, Tr3).

9. Fuel-air ratio correcting apparatus according to claim 8, characterized in that the timing member is an RC member (R8, R9, C1) and the trigger circuit (Th1, Th2, Tr3) is set to switch the electronic switch (Tr1) each time when the RC capacitor member (C1) is charged to a predetermined voltage, the charging time of the capacitor being regulatable by the control signal generator(s) (51, 52, 53, 54, 55).

10. Fuel-air ratio correcting apparatus according to claim 9, characterized in that the charging circuit path of the RC capacitor (C1) for the idle running fuel-air ratio correction contains an adjustable resistor (R9) with which the pulse repetition frequency for the current pulses of the pulse generator (40) is adjustable and which in idle running of the internal combustion engine provides the required corrective quantities of fuel.

11. Fuel-air ratio correction apparatus according to claim 10, characterized in that for the cold start fuel-air ratio correction, the pulse repetition frequency of the current pulses produced by the pulse generator (40) is regulated through a first control signal generator (52) containing a PTC resistor as the transducer in dependence on, particularly, the coolant temperature of the internal combustion engine, wherein a PTC resistor arranged in the coolant is connected in parallel to the regulating resistor (R9) for the idle running fuel-air ratio correction either at all times or, via a temperature sensor, only when the coolant temperature lies below a lower threshold value.

12. Fuel-air ratio correction apparatus according to claim 10 or 11, characterized in that for the hot start λ correction the pulse repetition frequency of the current pulses produced by the pulse generator (40) is regulated by a second control signal generator (53) containing an NTC resistor as the transducer in dependence on, in particular, the internal combustion engine temperature, wherein the NTC resistor arranged at the internal combustion engine is connected in parallel to the regulating resistor (R9) for the idle running fuel-air ratio correction, either permanently or, via a temperature sensor only when the engine temperature lies above an upper threshold value.

13. Fuel-air ratio correction apparatus according to one of claims 9, 10, 11 or 12, characterized in that the control signal generator (51) for fuel-air ratio correction in acceleration of the internal combustion engine contains a second charging current path (R61, R62) for the capacitor (C1) of the RC member and as a charging voltage source it also contains a capacitor (C60) with a capacitance which is sufficient for a multiple charging of the capacitor (C1) of the RC member and includes also a changeover switch (57, 58, 59) actuated by displacement of the throttle valve (18), the charging capacitor (C60) being connected via the change-over switch when the throttle valve moves in the closing direction to a voltage source and when the throttle valve moves towards the open position the capacitor is connected to a second charging current path (R61, R62) in order to charge the capacitor member (C1) of the RC member with its stored energy, wherein the second charging current circuit contains a regulating resistor (R61) with which the charging time of the capacitor (C1) of the RC member and, via the latter, the repetition frequency of the current pulses produced on acceleration by the pulse generator (40) and thereby the corrective quantitites of fuel required on acceleration of the internal combustion engine are all adjustable.

14. Fuel-air ratio correction apparatus according to claim 13, characterized in that the change-over switch (57, 58, 59) has a movable contact (57) which is connected via a friction coupling (56) arranged on the shaft (17) of the throttle valve with that shaft and on rotation of the throttle valve shaft is set in one direction against a fixed contact (58) and on rotation of the throttle valve shaft in the opposite direction is set against the other fixed contact (59), whereby both fixed contacts (58, 59) are at a small distance, in particular less than 1 mm, from each other.

15. Fuel-air ratio correction apparatus according to one of claims 9, 10, 11, 12 or 13, characterized in that the control signal generator (54) for the correction in dependence on air pressure contains a regulating resistor (R70) adjustable by barometric transducer (70) which resistor is connected in parallel with the regulating resistor (R9) for the idle running fuel-air ratio correction.

* * * * *